US005078844A

United States Patent [19]

Katsuma

[11] Patent Number: 5,078,844

[45] Date of Patent: Jan. 7, 1992

[54] METHOD FOR FORMING TOUGH, ELECTRICAL INSULATING LAYER ON SURFACE OF COPPER MATERIAL

[76] Inventor: Kunio Katsuma, 4-18-7 Tsuganodai, Chiba-shi, Chiba-ken, Japan

[21] Appl. No.: 652,503

[22] Filed: Feb. 8, 1991

[30] Foreign Application Priority Data

Feb. 19, 1990 [JP] Japan ..... 2-36346

[51] Int. Cl.[5] ..... C25D 11/34

[52] U.S. Cl. ..... 205/149; 205/151; 205/316; 205/333

[58] Field of Search ..... 204/25, 27, 56.1

[56] References Cited

FOREIGN PATENT DOCUMENTS 58-31099 2/1983 Japan .

*Primary Examiner*—T. M. Tufariello

*Attorney, Agent, or Firm*—Lowe, Price, LeBlanc & Becker

[57] ABSTRACT

An electrical insulating coating layer having excellent adhesion, toughness and heat resistance is formed on a surface of a copper material by anodizing the copper material under a low current in an acid bath of a hexacyanoiron complex. Copper materials such as coil wires can hence be provided with a thin, heat-resistant, electrical insulating layer, whereby the values of the copper materials can be heightened.

6 Claims, No Drawings

METHOD FOR FORMING TOUGH, ELECTRICAL INSULATING LAYER ON SURFACE OF COPPER MATERIAL

BACKGROUND OF THE INVENTION

1. Field of the Invention

This invention relates to a method for forming an insulating coating on surfaces of copper materials employed in various forms such as wires, rods, stranded cables, bands, tubes and pipes. More specifically, this invention provides a method for forming a tough, heat-resistant, electrical insulating layer on a surface of a copper material by anodizing the copper material in an acid bath of a hexacyanoiron complex.

2. Description of the Related Art

A variety of methods has heretofore been proposed for the formation of an electrical insulating coating layer (hereinafter simply called "electrical insulating layer") on surfaces of various materials, including the following methods:

i) Coating of an organic material:

For example, Scotch ® tapes (product of 3M Co., St. Paul, Minn., U.S.A.) are made of a polyester, PTFE or polyimide material and use a thermosetting silicone rubber or an acrylic adhesive. Although they have an excellent withstand voltage (dielectric strength), their heat resistance is below 200° C.

ii) Coating of an inorganic material: Proposed coatings include, for example, flexible coatings formed by firing glass fibers in combination with an organic substance rather than simply applying glass fibers; and coatings obtained by applying inorganic polymers which contain boron, silicon and/or oxygen and can be converted to ceramics when fired. These coatings are however thick and costly so that their use for electronic devices and equipment reduced in dimensions and improved in precision is unsuitable.

Incidentally, as a simple and easy method for forming a reliable, electrical insulating layer, there is a method in which 0.1-mm thick mica is coated with an adhesive and inorganic powder. This method however involves problems, for example, in coil winding or the like because the coating thus formed has poor adhesion to the substrate. A limitation is therefore imposed on its practical utility.

iii) Different from the above-described coating of an organic material or an inorganic material, there are methods for directly forming an electrical insulating layer on a surface of a conductor.

These methods include, for example, formation of alumite (i.e., anodic oxidation coating of aluminum) and anodization. These methods are both applicable only to those made of an aluminum-based material. When the degree of wire drawing becomes 0.5 mm or smaller in diameter, extreme difficulties are encountered and an increase in product cost is unavoidable. These methods therefore have poor practical utility.

Other methods have also been proposed, in which a copper material having excellent conductivity and excellent workability such as wire drawability is made electrically insulating at a surface thereof by chemical conversion or anodization. These methods however also have problems to be described below, so that their use in actual production is inhibited.

In chemical conversion, an electrolytic bath is prepared generally by adding a single alkali salt at a high concentration and an oxidizing agent, and a copper material to be treated is dipped at a high temperature in the electrolytic bath so that a layer of cupric oxide (CuO) is formed on a surface of the copper material. This method however requires not only a long time for the chemical conversion but also a rather high cost for the reagents, and its productivity is therefore poor.

In anodization, an electrical insulating layer composed of cupric oxide (CuO) is formed on a surface of a copper material at a high current density in a alkaline solution of a high concentration in order to ensure high productivity. In this anodization, cupric oxide thus formed is instantaneously redissolved even by a slightest variation in conditions (alkali concentration, current density), whereby its process control is extremely difficult. Anodization is generally conducted by setting the alkali concentration of the alkaline bath at a high level and maintaining the current density also at a high level.

Another serious problem of the above-mentioned anodization resides in that an anodized product must be washed thoroughly with water. If an alkali component should remain on the product, the alkali component may cause an insulation failure due to its hygroscopic action. The anodization mentioned above is therefore considered to have poor practical utility when large facilities, a lots of water and waste water treatment, all of which are required for the through washing with water, are taken into consideration. This water washing poses an especially serious problem when the product has a shape inconvenient for washing as in the case of a stranded cable, unavoidably resulting in extremely low productivity.

With a view toward overcoming the above-described drawbacks in the anodization of copper materials, there has been proposed an anodization method for a copper material in which plural alkaline bathes are arranged in a linear pattern, the alkali concentrations of the individual bathes are successively lowered in the travelling direction of the copper material, and the average anode current in each bath is lowered (Japanese Patent Application Laid-Open No. 31099/1983). In the conventional anodization methods including the improved anodization methods described right above, an electrical insulating layer formed on a surface of a copper material and composed of cupric oxide (CuO) has a large thickness and is weak against external strains so that it tends to develop cracks. Moreover, the heat resistance of the electrical insulating layer and its adhesion strength to the substrate are insufficient. For these reasons, the conventional anodization methods for copper materials cannot meet, for example, the stringent requirements for coils and the like that an extremely thin, heat-resistant, peel-free, electrical insulating layer must be formed.

OBJECT AND SUMMARY OF THE INVENTION

The present has been completed with a view toward overcoming the above-described drawbacks of the conventional techniques.

An object of the present invention is therefore to provide a method for the formation of an electrical insulating layer on a surface of a copper material which may be in any one of various forms, in which anodization is conducted using an acid-to-neutral side hexacyanoiron complex absolutely different from its counterpart component in a conventional anodization method making use of an alkaline bath, whereby an absolutely novel electrical insulating layer composed of a composite component of copper oxide and copper ferri(ferro) cyanide is formed on the surface of the copper material.

In one aspect of the present invention, there is thus provided a method for forming a tough, electrical insulating layer on a surface of a copper material, said copper material being made of copper at least in the surface thereof, which comprises anodizing the copper material under a low current in an acid bath of a hexacyanoiron complex.

The present invention can furnish, with extreme efficiency, a copper material having an electrical insulating layer which develops no or much less cracks or separation in various working such as wire drawing, has better heat resistance and higher adhesion to the substrate and is thinner, compared with electrical insulating layers formed by conventional anodization methods and composed of cupric oxide (CuO) alone.

DETAILED DESCRIPTION OF THE INVENTION

No particular limitation is imposed whatsoever on a material to be subjected to anodization under a low current in the above-described acid bath of the hexacyanoiron complex insofar as its surface is made of copper. This material will hereinafter be called a "copper material". Accordingly, the present invention can also be applied to materials in which the bases (i.e., substrates) are not a copper-based material (for example, an iron-based material) but are provided with a copper layer such as a copper plating layer.

Copper materials of this sort can be selected from those having various forms, such as bands, rods, wires, stranded cables, tubes and pipes.

According to the present invention, a surface of a copper material is subjected to oxidation treatment by anodization. A principal feature of this invention resides in the composition of the electrolytic bath, which is absolutely different from those employed in the conventional anodization methods.

This invention uses, as an electrolytic bath, an acid bath of a hexacyanoiron complex. Hexacyanoiron complexes of this sort include hexacyanoferrates (II) and hexacyanoferrates (III). Specific examples include potassium ferrocyanide (potassium hexacyanoferrate (II), $K_4[Fe(CN)_6]$) and potassium ferricyanide (potassium hexacyanoferrate (III), $K_3[Fe(CN)_6]$).

It is for the following reasons that a hexacyanoiron complex is used as a principal component of an anodization bath in the present invention.

It is to suppress the formation of a single-component layer (electrical insulating layer) of cupric oxide (CuO) alone on a surface of a copper material by anodization that CN (cyano) ions are caused to exist in a bath by using a hexacyanoferrate (II) or a hexacyanoferrate (III). Use of a single salt of CN ions however results in an alkaline bath, leading to the potential problem that formed cupric oxide (CuO) may be dissolved again. To cope with this potential problem, the present invention uses the electrolytic bath in a substantially neutral to acidic state and also a CN-ion yielding compound in the form of a complex compound.

The above-mentioned effectiveness of CN ions has been found from the fact, in both electroplating and electroless plating, a plating bath containing CN ions can provide a softer and glossier film than a plating bath free of CN ions. Inclusion of CN ions can suppress the formation of cupric oxide (CuO) alone as will be described below.

CN ions are used as a ferrate in the present invention, so that copper ions are progressively leached under an applied current from the copper material as an anode as the anodization proceeds. These copper ions are believed to react with the complex, whereby copper ferrocyanide or copper ferricyanide are formed as shown below. Incidentally, the surface of the copper material is generally covered with cuprous oxide ($Cu_2O$) of a reddish brown color. This copper oxide is considered to give off Cu ions or to undergo the oxidation ($Cu_2O \rightarrow CuO$) upon anodization so that the anodization is allowed to proceed.

$$K_4[Fe(CN)_6] + Cu^+ \rightarrow Cu_4[Fe(CN)_6] \quad (1)$$

$$K_3[Fe(CN)_6] + Cu^+ \rightarrow Cu_3[Fe(CN)_6] \quad (2)$$

The copper ferrocyanide (1) or copper ferricyanide (2) so formed is progressively oxidized as the anodization proceeds, whereby it partly undergoes chemical conversion to cupric oxide (CuO). The progress of this reaction can be visually observed.

Namely, in the step of oxidization treatment by anodization, at the beginning of application of a current, the surface of the copper material is formed of a layer of cuprous copper ($Cu_2O$) or copper ferro(or ferri)cyanide and cupric oxide (CuO) of a black color is not observed at all. As the time goes on, the surface however gradually becomes darker and the black tone is also intensified. It is hence observed that the formation of cupric oxide (CuO) is going on. This change is considered to be attributable to the conversion of a portion of copper ferro(or ferri)cyanide, which has been formed in the beginning of the anodization, to cupric oxide (CuO) by [O] or $O_2$ occurred from the anode.

As has been described above, in the anodization method of the present invention, a single-component layer of black cupric oxide (CuO) is not formed on the surface of the copper material but a composite layer formed in combination of cupric oxide (CuO) and copper ferro(or ferri)cyanide is formed there.

It is an essential requirement that the above-described acid bath of the hexacyanoiron complex be used. To achieve efficient formation of a composite layer, it is also important to control a current at a lower level. As a rough standard, a current density (CA) not higher than 2 $A/cm^2$ is sufficient. The anodization is preferably constant-current anodization, in which the voltage may be 1–15 V, with 2–8 V being preferred. In the anodization of the present invention, particular care must be exercised to reduce the generation of [O] and $O_2$ from the surface of the anode. Excess generation of such gas makes it difficult to achieve the object of the present invention.

As conditions for the anodization method of the present invention, it is only necessary to conduct anodization at the above-described current density, preferably at a complex concentration of 5–100 g/l and a pH of 3–8 for 10–15 minutes, more preferably at a complex concentration of 10–40 g/l and a pH of 3–7.5 for 10–15 minutes, most preferably at a salt concentration of 20–30 g/l and a pH of 6–7 for 2–3 minutes.

Another principal feature of the present invention resides in the structure of the composite layer formed on the surface of the copper material as an electrical insulating layer composed in combination of cupric oxide (CuO) and copper ferro(or ferri)cyanide.

As is observed in conventional anodized aluminum products, for example, a coating on an anodized aluminum wire has a double-layer structure composed of a thin barrier layer of aluminum oxide formed on a surface of the aluminum base or substrate material and a thick porous layer of porous aluminum oxide formed on the barrier layer and having the porosity of about 20%. The dielectric strength of the anodized aluminum wire is governed by the degree of the dielectric strength of air layers in the porous layer. As is well known, this porous layer is inherently brittle. Compared with the structure of the coating of the above-described anodized aluminum product, the structure of the above-described composite layer in the present invention is considered to correspond to the barrier layer firmly adhered to the base material despite of its small thickness. According to a more microscopic observation of the composite layer of this invention, the composite layer is considered to have a multilayer structure such that the concentration of copper ferro(or ferri)cyanide is high in a region close to the surface of the base material, i.e., the copper material and the concentration of cupric oxide (CuO) becomes gradually higher as the distance from the surface of the base material becomes greater.

The composite layer as the electrical insulating layer in this invention is formed by conducting anodization in the specific complex bath and oxidizing copper ferro(or ferri)cyanide formed in an initial stage of the anodization and has a structure absolutely different from electrical insulating layers formed by conventional anodization techniques for Al or Cu materials.

The present invention makes it possible to extremely efficiently a tough, electrical insulating layer on a surface of a copper material. The electrical insulating layer according to the present invention is different from conventional single layers made of copper oxide but is a thin composite layer composed in combination of copper oxide and copper ferri(or ferro)cyanide. The composite layer firmly adheres to the copper base material and has excellent heat resistance. Copper materials which have, on their surfaces, an electrical insulating layer of the excellent properties provided in accordance with this invention can therefore be used in a variety of fields.

In particular, reflecting the technological advancement, the improvements in precision and the reductions in dimensions of high-technology industrial equipment, it is now required to meet stringent use conditions. Electrical insulating layers according to this invention can successfully meet such requirements. For example, complex wiring, small-diameter coil winding and the like are required for various coils to be used in magnetic heads, VTR motors, stators, fan motors, etc. These requirements in turn require materials which remain substantially free from the influence of vacancy, porosity, temperature and the like. The present invention has also made it possible to effectively meet these requirement.

The present invention will hereinafter be described in more detail. It should however be borne in mind that this invention is not limited to or by the following examples.

EXAMPLE 1

An aqueous solution containing 20 g/l of potassium ferricyanide (red prussiate), $K_3[Fe(CN)_6]$, was prepared. HCl was added to adjust its pH to 6. The aqueous solution was then heated to 40° C. to provide an electrolytic bath.

Next, 0.9 gram (365 cm) of a copper wire having the diameter of 0.2 mm was wound into a coil (coil diameter: 6 mm). The coil was used as an anode, while a carbon electrode was used as a cathode.

Anodization was conducted by controlling the current below the current density of 2 A/cm$^2$ while gradually increasing the current density within a range in which occurrence of gas such as [O] or $O_2$ from the surface of the anode was not observed to the eye (current density: 1–1.5 A/cm$^2$). During the anodization, the voltage increased from 2 V to 9 V. The anodization was conducted for 6 minutes, whereby an electrical insulating layer having a dark brown color and the average thickness of 2.5 μm was formed.

After the anodization, the coil was unwound into a linear form. The electrical insulating layer underwent neither separation nor cracking. In addition, the coil was subjected to heat treatment for 10 minutes in a muffle furnace controlled at 400° C. The coil was also unwound into a linear form. Again, neither separation nor cracking was observed.

Using a withstand voltage tester ("Model TOS 8750", trade name; manufactured by Kikusui Electronics Industries, Ltd.), the dielectric strength of the electric insulating layer formed as described above was measured in accordance with the metal cylinder method prescribed in JIS C3003. Its dielectric strength was 150 V. Incidentally, the wire not wound into the coil showed the dielectric strength of 600 V.

EXAMPLE 2

Using a cable obtained by stranding eight copper wires having the diameter of 0.1 mm and the length of 100 cm, anodization was conducted in a similar manner to Example 1. During the anodization, the current density (CD) increased from 1 A/cm$^2$ to 1.5 A/cm$^2$ while the voltage arose from 2 V to 15 V.

The anodization was conducted for 4 minutes, whereby an insulating layer having a dark, somewhat black, brown color was formed to the thickness of 1.5 μm on the surface.

The anodized cable was wound into a coil having the diameter of 4 mm. The insulating layer underwent neither separation nor cracking. Its heat resistance was exactly the same as the anodized wire obtained in Example 1.

Next, its conducting resistance was measured by a tester ("Model BX-505", trade name; manufactured by Sanwa Denki Co., Ltd.). The conducting resistance of 10 KΩ×10 was indicated.

COMPARATIVE EXAMPLE 1

The samples of Examples 1 and 2 were treated using a chemical conversion solution which has been prepared by adding ammonium persulfate at the concentration of 5 g/l to an aqueous solution containing NaOH at the concentration of 150 g/l. The chemical oxidation was conducted by dipping the respective samples at 90° C. for 20 minutes in the chemical conversion solution. As a result, the resulting electrical insulating layers were found to have extremely insufficient adhesion. They were separated at many locations and were cracked.

I claim:

1. A method for forming a tough, electrical insulating layer on a surface of a copper material, said copper material being made of copper at least in the surface thereof, which comprises anodizing the copper material under a low current in an acid bath of a hexacyanoiron complex.

2. The method of claim 1, wherein the copper material is anodized at a complex concentration of 5–100 g/l, a pH of 3–8 and a current density not higher than 2 $A/cm^2$ in the acid bath of the hexacyanoiron complex.

3. The method of claim 1, wherein the copper material is anodized at a complex concentration of 10–40 g/l, a pH of 3–7.5 and a current density not higher than 2 $A/cm^2$ in the acid bath of the hexacyanoiron complex.

4. The method of claim 1, wherein the copper material is anodized at a complex concentration of 20–30 g/l, a pH of 6–7 and a current density not higher than 2 $A/cm^2$ in the acid bath of the hexacyanoiron complex.

5. The method of claim 1, wherein the copper material is anodized at a complex concentration of 5–100 g/l, a pH of 3–8 and a current density not higher than 2 $A/cm^2$ for 1–15 minutes in the acid bath of the hexacyanoiron complex.

6. The method of claim 1, wherein the copper material made of copper at least in the surface thereof is selected from the group consisting of bands, rods, wires, stranded cables, tubes and pipes.

* * * * *

UNITED STATES PATENT AND TRADEMARK OFFICE

CERTIFICATE OF CORRECTION

PATENT NO. : 5,078,844

DATED : January 7, 1992

INVENTOR(S) : Kunio KATSUMA

It is certified that error appears in the above-indentified patent and that said Letters Patent is hereby corrected as shown below:

Col. 4, line 48, change "2 A/cm$^2$" to --2 A/dm$^2$--

Col. 6, line 8, change "2 A/cm$^2$" to --2 A/dm$^2$--

Col. 6, line 12, change "1-1.5 A/cm$^2$" to --1-1.5 A/dm$^2$--

Col. 6, line 38, change "1 A/cm$^2$ to 1.5 A/cm$^2$" to --1 A/dm$^2$ to 1.5 A/dm$^2$--

Col. 7, claim 2, line 4, change "A/cm$^2$" to --A/dm$^2$--

Col. 7, claim 3, line 4, change "A/cm$^2$" to --A/dm$^2$--

Col. 8, claim 4, line 4, change "A/cm$^2$" to --A/dm$^2$--

UNITED STATES PATENT AND TRADEMARK OFFICE

CERTIFICATE OF CORRECTION

PATENT NO. : 5,078,844

DATED : January 7, 1992

INVENTOR(S) : Kunio KATSUMA

It is certified that error appears in the above-indentified patent and that said Letters Patent is hereby corrected as shown below:

Col. 8, claim 5, line 4, change "$A/cm^2$" to --$A/dm^2$--.

Signed and Sealed this

Twenty-second Day of November, 1994

*Attest:*

Bruce Lehman

BRUCE LEHMAN

*Attesting Officer*

*Commissioner of Patents and Trademarks*